US009447529B2

(12) United States Patent
Dunker

(10) Patent No.: US 9,447,529 B2
(45) Date of Patent: Sep. 20, 2016

(54) CORD MATERIAL AND METHODS OF USING SAME

(71) Applicant: Garrett Storm Dunker, Houston, TX (US)

(72) Inventor: Garrett Storm Dunker, Houston, TX (US)

(73) Assignee: A-Z CHUTEWORKS L.L.C., Houston, TX (US)

( * ) Notice: Subject to any disclaimer, the term of this patent is extended or adjusted under 35 U.S.C. 154(b) by 139 days.

(21) Appl. No.: 14/090,025

(22) Filed: Nov. 26, 2013

(65) Prior Publication Data

US 2015/0143981 A1 May 28, 2015

(51) Int. Cl.

| | |
|---|---|
| ***D04C 1/12*** | (2006.01) |
| ***D07B 5/00*** | (2006.01) |
| *D07B 1/02* | (2006.01) |
| *D07B 1/18* | (2006.01) |

(52) U.S. Cl.

CPC ..... *D04C 1/12* (2013.01); *D07B 5/005* (2013.01); *D07B 1/025* (2013.01); *D07B 1/18* (2013.01); *D07B 2201/1016* (2013.01); *D07B 2201/1096* (2013.01); *D07B 2205/2014* (2013.01); *D07B 2205/2042* (2013.01); *D07B 2401/201* (2013.01)

(58) Field of Classification Search

CPC D04C 1/12; D07B 5/005; D07B 2201/1016; D07B 2201/1096

See application file for complete search history.

(56) References Cited

U.S. PATENT DOCUMENTS

| | | | | |
|---|---|---|---|---|
| 2,032,265 A | | 7/1932 | Dawes | |
| 2,100,543 A | | 8/1935 | Hamilton | |
| 2,700,317 A | | 3/1953 | Lilienfeld | |
| 3,059,518 A | | 2/1956 | Nelson | |
| 3,991,550 A | | 11/1976 | Cohen | |
| 4,158,984 A | | 6/1979 | Griffiths | |
| 4,836,080 A | * | 6/1989 | Kite, III | B65G 53/523 138/103 |

(Continued)

FOREIGN PATENT DOCUMENTS

| | | |
|---|---|---|
| DE | 202013102018 U1 | 5/2013 |
| FR | 2995594 | 7/2011 |

(Continued)

OTHER PUBLICATIONS

European Patent Office, English translation of abstract of JP2006322126, Nov. 30, 2006.

*Primary Examiner* — Shaun R Hurley

(74) *Attorney, Agent, or Firm* — Ashley Law Firm P.C.

(57) ABSTRACT

A cord material suitable for use in lined textile structures with a gliding component includes a plurality of uniform strands, and a deviant strand. The deviant strand is different from the uniform strands in some characteristic affecting aerodynamic or hydrodynamic properties of the cord, such as size or surface properties. Each uniform strand can have a substantially equal cross section area, while the deviant strand has a cross section area at least five times greater than one of the uniform strands. The strands can be braided or woven together. A major benefit of the material can be that vibration induced drag is significantly reduced or eliminated in lines made with the material. Another advantage is that lines made from the material can have more consistent, predictable line drag, which can improve the quality of handling.

14 Claims, 2 Drawing Sheets

(56) References Cited

U.S. PATENT DOCUMENTS

| | | | | |
|---|---|---|---|---|
| 5,127,783 | A * | 7/1992 | Moghe | B29C 70/222 156/172 |
| 5,272,796 | A * | 12/1993 | Nichols | A43C 9/00 24/712 |
| 5,322,049 | A | 6/1994 | Dunlap | |
| 5,673,546 | A * | 10/1997 | Abraham | A43C 9/00 24/713 |
| 5,744,206 | A * | 4/1998 | Russek | D04C 1/02 138/123 |
| 5,809,861 | A | 9/1998 | Hummel | |
| 5,901,632 | A | 5/1999 | Ryan | |
| 6,147,303 | A * | 11/2000 | Abe | G02B 6/4419 174/117 R |
| 6,283,004 | B1 * | 9/2001 | Tseng | D07B 5/005 57/230 |
| 7,028,542 | B2 | 4/2006 | Metni | |
| 7,275,471 | B2 | 10/2007 | Nishri et al. | |
| 8,387,505 | B2 | 3/2013 | Chou et al. | |
| 2005/0082083 | A1 * | 4/2005 | Nolan | A01K 3/005 174/128.2 |
| 2005/0160656 | A1 | 7/2005 | Safwat et al. | |
| 2006/0021428 | A1 | 2/2006 | Metni | |
| 2006/0130642 | A1 | 6/2006 | Tomich et al. | |
| 2007/0079483 | A1 * | 4/2007 | Gunnarsson | A01K 75/00 24/129 R |
| 2010/0026007 | A1 | 2/2010 | Bevirt | |
| 2010/0274282 | A1 * | 10/2010 | Olson | A61L 17/04 606/228 |
| 2012/0118131 | A1 * | 5/2012 | Erlendsson | A01K 75/00 87/6 |
| 2012/0285074 | A1 | 11/2012 | Yang | |
| 2013/0247536 | A1 * | 9/2013 | Erlendsson | D07B 5/00 57/309 |
| 2014/0373704 | A1 * | 12/2014 | Safwat | D07B 1/22 87/7 |

FOREIGN PATENT DOCUMENTS

| | | |
|---|---|---|
| JP | 2006322126 | 11/2006 |
| WO | WO2006055995 | 6/2006 |
| WO | WO2011009924 | 1/2011 |

* cited by examiner

CORD MATERIAL AND METHODS OF USING SAME

TECHNICAL FIELD AND BACKGROUND OF THE INVENTION

The present invention relates to a cord material having reduced drag force when subjected to fluid flow. The cord material can be suitable for use in lined textile structures with a gliding component, such as kites. An embodiment of the invention comprises a plurality of braided or woven strands, in which at least one strand is different from the other strands in size, surface properties, or other characteristic affecting aerodynamic or hydrodynamic properties relating to the cord.

In loaded line systems, such as kites, the lines typically experience wide ranges in angle of attack and relative wind speed during normal usage. Line drag in these systems is considered parasitic drag, and can make up a sizeable portion of total wing drag, reportedly up to thirty percent for large wings with a high number of lines. At some critical angles of attack and airspeeds, lines can enter a vibration mode in which a given line drag has been shown to increase to about 250%. Line drag spikes or peaks, troughs or gullies, resulting from specific combinations of wind conditions can cause poor handling, inconsistent, and/or other than expected results from control inputs.

SUMMARY OF THE INVENTION

Therefore, one object of the present invention is to provide a cord having improved drag performance characteristics. Another object of the present invention is to provide a cord construction that greatly reduces or eliminates vibration induced drag. Yet another object of the present invention is to provide a cord material that is particularly suitable for use in loaded line systems, such as kite lines or tethers. These and other objects of the present invention can be achieved in the various embodiments of the invention disclosed below.

One embodiment of the invention comprises a braided or woven line or cord material exhibiting improved fluid drag performance. The material is particularly suitable for lined textile structures with a gliding component, such as kites, however, many other applications exist. The material comprises a plurality of strands, such as eight, twelve, or sixteen strands within the braid or weave, with at least one of the strands being a deviant strand that is different from the other strands in some way. The deviant strand can be different in size, surface properties, and/or other characteristic that affects aerodynamic or hydrodynamic properties of the line. A major benefit is that vibration induced drag can be significantly reduced or eliminated in lines made according to the invention. Since the lines can have more consistent, predictable line drag across all angles of attack and airspeeds, the quality of handling can be improved.

According to another embodiment of the invention, a cord comprises a plurality of uniform strands, and a deviant strand. Each uniform strand has a substantially equal cross section area, and the deviant strand has a cross section area at least two times greater than one of the uniform strands.

According to another embodiment of the invention, the plurality of uniform strands are made of identical material.

According to another embodiment of the invention, the deviant strand is made from the same material as the uniform strands.

According to another embodiment of the invention, the uniform strands and the deviant strand are comprised of a polymeric material.

According to another embodiment of the invention, the deviant strand is about thirty percent of the total cross section area of the cord.

According to another embodiment of the invention, the plurality of uniform strands and the deviant strand are braided together.

According to another embodiment of the invention, the plurality of uniform strands and the deviant strand are braided together using a coreless round braid pattern. It should be noted, however, that the final product does not necessarily have a round cross section. In this embodiment, the cord is hollow and spliceable, such that the cord can be inserted into itself to form an end loop.

According to another embodiment of the invention, the uniform strands and the deviant strand are woven together.

According to another embodiment of the invention, the cord has at least eleven uniform strands.

According to another embodiment of the invention, the deviant strand has a cross section area approximately five times greater than one of the uniform strands.

According to another embodiment of the invention, the deviant strand forms a protrusion on the cord outer mold line.

According to another embodiment of the invention, the uniform strands and the deviant strand have a substantially round cross section.

According to another embodiment of the invention, a cord comprises a plurality of uniform polymeric strands having a substantially equal cross section area, and a deviant polymeric strand having a cross section area at least five times greater than one of the uniform strands. The uniform polymeric strands and the deviant polymeric strand are braided together.

According to another embodiment of the invention, the plurality of uniform polymeric strands include at least eleven strands.

According to another embodiment of the invention, each of the uniform polymeric strands and the deviant polymeric strand are comprised of an identical material, such as a long chain polyethylene, an ultra high molecular weight polyethylene, or a liquid crystal polymer.

According to another embodiment of the invention, the uniform strands and the deviant strand have a substantially circular cross section, and the deviant strand forms a substantially helical protrusion on the cord.

According to another embodiment of the invention, a cord for use in lined textile structures with a gliding component, such as a kite line or tether, comprises a plurality of uniform polymeric strands, and a deviant polymeric strand. Each uniform strand has a substantially equal cross section area. The deviant polymeric strand has a cross section area at least five times greater than one of the uniform strands and forms a substantially helical protrusion on the cord.

According to another embodiment of the invention, the uniform polymeric strands and the deviant strand total twelve strands, and all of the strands are comprised of identical material, such as a long chain polyethylene, an ultra high molecular weight polyethylene, or a liquid crystal polymer.

According to another embodiment of the invention, the variance of physical properties of the strands can result in asymmetrical drag of the cord line, while not causing knobby surface perturbations. For example, one of the carriers can be more or less smooth than the neighboring carriers or more or less fuzzy than the other carriers.

According to another embodiment of the invention, an additional carrier or carriers can be added on top of a normal carrier configuration for the same asymmetrical performance, i.e. not making one of the existing carriers larger, adding a thirteenth carrier to a twelve carrier line.

A cord according to another embodiment of the invention comprises a plurality of uniform polymeric strands, and a deviant polymeric strand. Each uniform strand has a substantially similar surface finish, and the deviant polymeric strand has a surface finish substantially rougher than the surface finish of each uniform strand.

According to another embodiment of the invention, each uniform strand has a substantially equal skin friction coefficient, and the deviant strand has a skin friction coefficient more than twice the skin friction coefficient of each uniform strand.

DESCRIPTION OF THE PREFERRED EMBODIMENTS OF THE INVENTION AND BEST MODE

Figure 1:
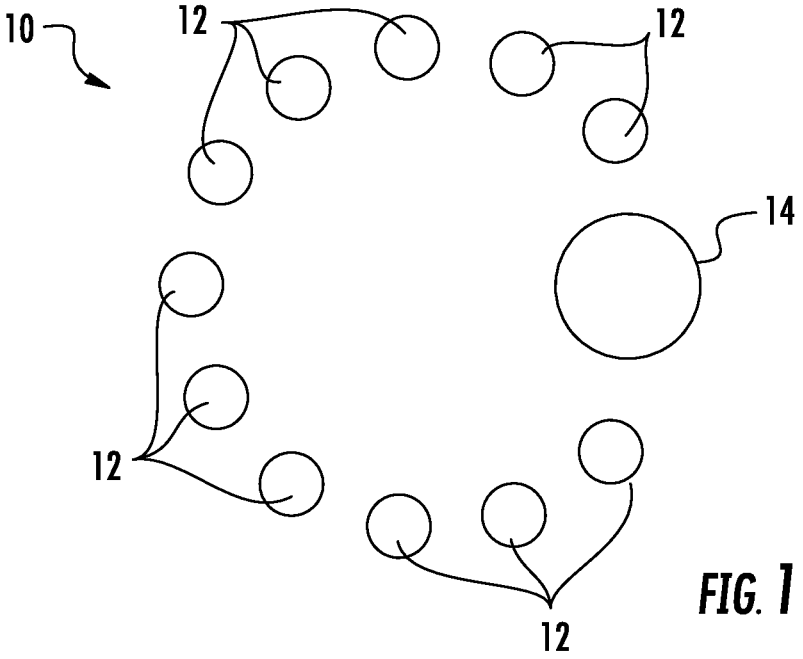
FIG. 1 is schematic cross sectional view of a cord according to a preferred embodiment of the invention.

A cord according to a preferred embodiment of the invention is illustrated in FIG. 1, and shown generally at reference numeral 10. As used herein the term "cord" refers generally to any cord, rope, or line type structure comprising a plurality of strands that are braided, woven, twisted or otherwise joined together. The cord 10 comprises a plurality of uniform strands 12, and at least one deviant strand 14.

As shown in FIG. 1, the cord 10 can have a total of eleven uniform strands 12, and one deviant strand 14. The strands 12, 14 have a substantially circular cross section, and can be braided together. The uniform strands 12 form a base braid having a substantially circular cross sectional shape.

Figure 2:
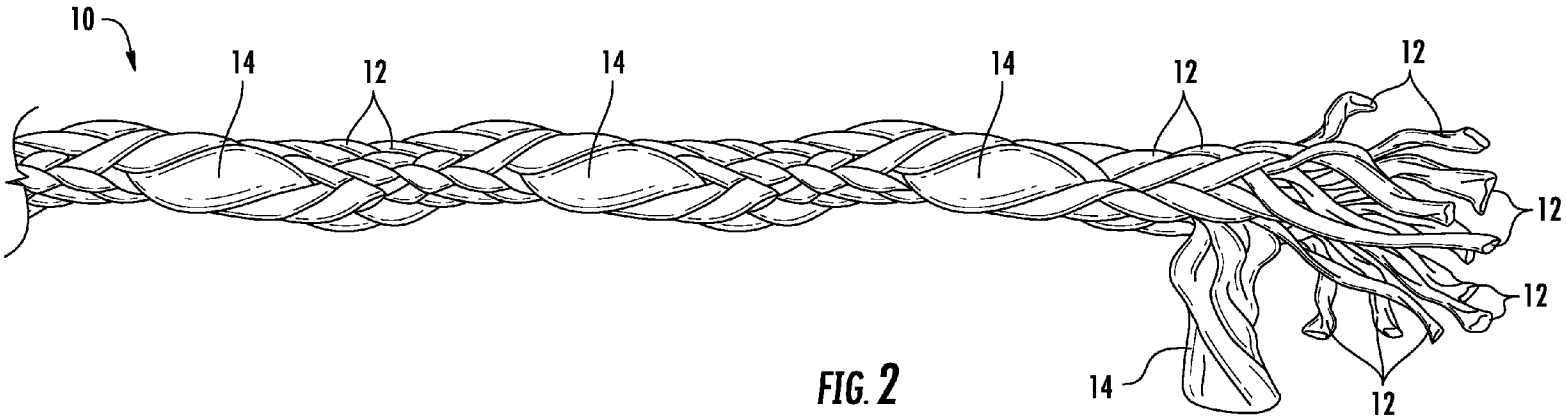
FIG. 2 is a perspective view of the cord of FIG. 1.

As shown in FIG. 1, each of the uniform strands 12 have a substantially equal cross section area, and the deviant strand 14 has a cross section area approximately five times greater than one of the uniform strands 12. The much larger deviant strand 14 forms a protrusion on the otherwise round cord 10. As shown in FIG. 2, the protruding deviant strand can spiral along the length of the cord 10 in a substantially helical orientation. The helical protrusion of the deviant strand 14 results in the cord 10 having greater stability and less vibration at critical wind conditions.

The helical protrusion of the deviant strand 14 is important to the aerodynamic properties of the cord 10. An angle of attack of seventy to eighty degrees is commonly where a circular cross section line vibrates when at low airspeeds. The size and pitch (distance along line for one turn) of the protrusion of the deviant strand 14 are predetermined to create the effective localized vortex in the trailing airflow with designed asymmetry along the length of cord 10.

The strands 12, 14 of the cord can be braided together on a braiding machine operating at fixed speed. The pitch of the helical protrusion of the deviant strand 14 can be adjusted by modifying the speed that the cord 10 is pulled off the braiding machine. The size of the helical protrusion can be adjusted by modifying the size of the deviant strand 14. Alternatively, if a smaller pitch is desired, a second deviant strand 14 can be added to the cord 10, opposite in location to the first deviant strand 14, but spiraling in the same direction (i.e, same helical orientation).

The strands 12, 14 of the cord 10 can be made of a polymeric material, such as the long chain polyethylene fiber sold under the trade name DYNEEMA, the ultra high molecular weight polyethylene fiber sold under the trade name SPECTRA, and/or the liquid crystal polymer sold under the trade name VECTRAN. Preferably, all of the uniform strands 12 and the deviant strand 14 are made of the same material. Making all of the strands 12, 14 from identical material provides several benefits. First, having all strands 12, 14 comprised of the same material will generally maximize the life of the cord 10. In addition, having the larger deviant strand 14 comprised of the same material as the uniform strands 12 increases the overall strength of the cord 10 when the cord 10 is loaded and stretched, since strands of identical material will stretch at the same rate. As such, the larger deviant strand 14 adds to the overall strength of the cord 10 as it stretches at the same rate as the uniform strands 12 and therefore will bear a proportionate share of the load on the cord 10.

In a preferred embodiment, the uniform strands 12 and the deviant strand 14 are made of the long chain polyethylene fiber sold under the trade name DYNEEMA. Preferably, the DYNEEMA has a Decitex (dtex) of 880, and the deviant strand 14 constitutes about thirty percent (30%) of the total cross section area of the cord 10.

Figure 3:
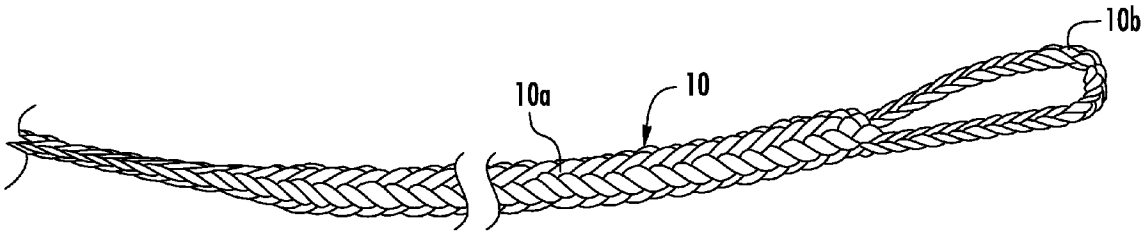
FIG. 3 is a perspective view of a cord according to a preferred embodiment of the invention.

The cord 10 is braided in a round braid with a hollow center axis. Alternatively, the cord 10 can be braided in flat or oval braids as these configurations can also experience vibration modes. The cord 10 is splice-able so the cord 10 can be inserted into itself, as shown at reference numeral **10*a* in FIG. 3. As such, the tail end of the cord 10 becomes a core extending through the previously hollow center of the cord 10, and can form a loop 10*b* using a traditional fid or other finger trapping tool. A twelve or greater strand braid is preferred for facilitating fingertrap-ability. In addition, a second large deviant strand may improve fingertrap-ability of the cord 10**, by providing a symmetry in the braid. Multiple large deviant strands positioned symmetrically can provide asymmetrical drag, while providing improved weave stability and finger trap-ability. In addition, one or more larger deviant strands can produce a line with superior knot holding ability, whereby a tied knot would be less likely to slip.

In a method of using the cord 10 according to a preferred embodiment of the invention, the cord 10 can be used in a kite line. When so used, the cord 10 should be permanently stretched to take out all mechanical slack in the cord 10.

Figure 4:
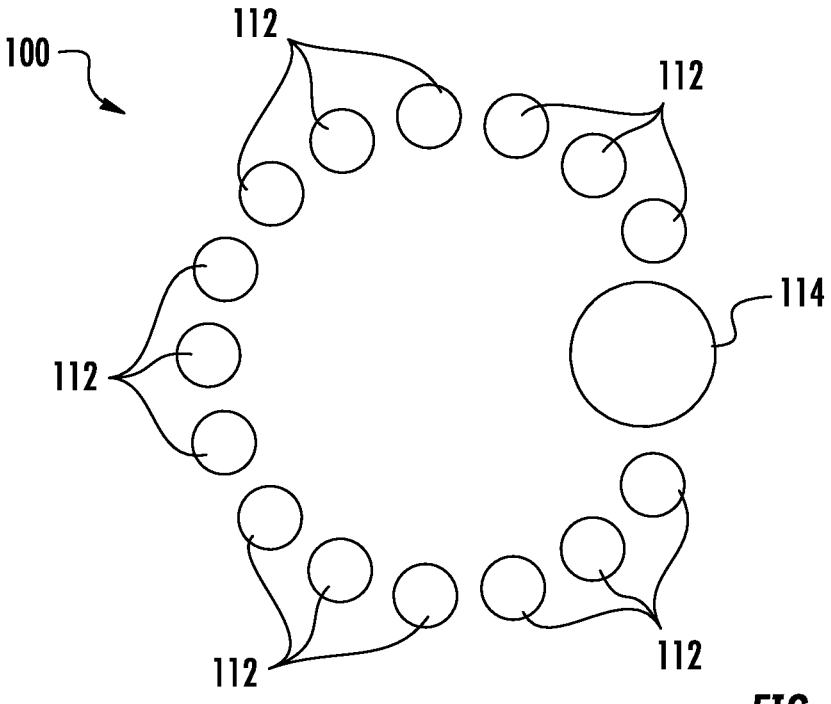
FIG. 4 is a schematic cross sectional view of a cord according to another preferred embodiment of the invention.

A cord according to another preferred embodiment of the invention is illustrated in FIG. 4, and shown generally at reference numeral 100. The cord 100 is identical to the previously described cord 10, except that the cord 100 has fifteen uniform strands 112, and one deviant strand 114, for a total of sixteen strands 112, 114.

According to another preferred embodiment of the invention, a cord comprises a plurality of uniform strands and at least one deviant strand. Each of the uniform strands and the deviant strand are substantially equal in size and have substantially the same cross section area, with the deviant strand being different from the uniform strands in another way to affect aerodynamic and/or hydrodynamic properties of the cord. The deviant strand has approximately the same cross section area as the uniform strands but has a surface finish that is different from the surface finish of the uniform strands. Each uniform strand has the same surface finish. The surface finish of the deviant strand can be comprised of a material having a rougher or fuzzier surface than the material of the uniform strands. Alternatively, the deviant strand and the uniform strands can be comprised of the same material, and the surface finish of the deviant strand can be made relatively rougher or fuzzier than the surface finish of the uniform strands by a mechanical process. The surface finish of the deviant strand can have a localized skin friction coefficient of more than twice the uniform strand skin friction coefficient of the uniform strands. The cord can have a skin friction coefficient of about 0.02.

In yet another alternative embodiment, a deviant strand having a surface that is made relatively fuzzier than the uniform strands by mechanical operations can be a braided line itself. The deviant strand can be a relatively small braided line having a cross section area substantially equal to each of the uniform strands.

A cord and a method of using same are described above. Various changes can be made to the invention without departing from its scope. The above description of the preferred embodiments and best mode of the invention are provided for the purpose of illustration only and not limitation—the invention being defined by the following claims and equivalents thereof.

What is claimed is:

1. A cord comprising:

(a) a plurality of uniform strands, each uniform strand having a substantially equal cross section area and comprising at least one fiber selected from the group consisting of ultra-high molecular weight polyethylene and long chain polyethylene;

(b) a deviant strand having a cross section area at least two times greater than one of the uniform strands, the deviant strand comprising at least one fiber selected from the group consisting of ultra-high molecular weight polyethylene and long chain polyethylene; and (c) wherein the plurality of uniform strands and the deviant strand are braided together in a substantially round braid, and the cord is hollow and spliceable, whereby an end of the cord can be inserted into itself to form an end loop.

2. The cord according to claim 1, wherein the plurality of uniform strands are comprised of identical material.

3. The cord according to claim 2, wherein the deviant strand is comprised of the same material as the plurality of uniform strands.

4. The cord according to claim 1, wherein the deviant strand comprises about thirty percent of a total cross section area of the cord.

5. The cord according to claim 1, wherein the plurality of uniform strands comprise at least eleven strands.

6. The cord according to claim 1, wherein the deviant strand has a cross section area approximately five times greater than one of the uniform strands.

7. The cord according to claim 1, wherein the deviant strand forms a protrusion on the cord.

8. The cord according to claim 1, wherein the plurality of uniform strands and the deviant strand have a substantially round cross section.

9. A cord for use in lined textile structures with a gliding component comprising:

(a) a plurality of uniform polymeric strands, each uniform strand having a substantially equal cross section area, and wherein the plurality of uniform polymeric strands comprises at least eleven strands;

(b) a deviant polymeric strand having a cross section area at least five times greater than one of the uniform strands and defining a substantially helical protrusion on the cord;

(c) wherein the plurality of uniform polymeric strands and the deviant polymeric strand are braided together in a braid having no core member, whereby the cord has a hollow core; and (d) wherein each of the plurality of uniform polymeric strands and the deviant polymeric strand are comprised of identical material selected from the group consisting of a long chain polyethylene, and an ultra high molecular weight polyethylene.

10. The cord according to claim 9, wherein the cord is spliceable, and an end of the cord is inserted into the hollow core to form an end loop.

11. A cord comprising:

(a) a plurality of uniform strands, each uniform strand having a substantially equal cross section area and comprising at least one fiber selected from the group consisting of ultra high molecular weight polyethylene and long chain polyethylene;

(b) a deviant strand having a cross section area at least two times greater than one of the uniform strands and comprising at least one fiber selected from the group consisting of ultra high molecular weight polyethylene and long chain polyethylene; and (c) wherein the plurality of uniform strands and the deviant strand are braided together in a braid having no core member, whereby the cord has a hollow core.

12. The cord according to claim 11, wherein the plurality of uniform strands and the deviant strand are braided together in a round braid.

13. The cord according to claim 11, wherein the cord is spliceable, and an end of the cord is inserted into the hollow core to form an end loop.

14. The cord according to claim 11, wherein the deviant strand defines a substantially helical protrusion on the cord.

* * * * *